United States Patent [19]

Shu et al.

[11] Patent Number: 4,988,100

[45] Date of Patent: Jan. 29, 1991

[54] TENNIS RACKET WITH SEPARABLE HEAD AND HANDLE ASSEMBLY

[76] Inventors: Donald G. C. Shu, 215 Virginia Ave. #203, San Mateo, Calif. 94402; Norbert J. Stein, 3054 Harding Ave., Santa Clara, Calif. 95051; Claude A. S. Hamrick, 19570 Montevina Rd., Los Gatos, Calif. 95030

[21] Appl. No.: 332,480

[22] Filed: Apr. 3, 1989

[51] Int. Cl.[5] ..... A63B 49/02; A63B 49/08

[52] U.S. Cl. ..... 273/73 C; 273/73 G; 273/73 L

[58] Field of Search ..... 273/73 R, 73 C, 73 G, 273/73 H, 73 J, 73 L

[56] References Cited

U.S. PATENT DOCUMENTS

| | | | |
|---|---|---|---|
| 2,004,609 | 3/1932 | Johnston | 273/73 L |
| 4,077,627 | 3/1978 | Cheatham | 273/73 R |
| 4,746,119 | 5/1988 | Jeanrot | 273/73 C |

FOREIGN PATENT DOCUMENTS

| | | | |
|---|---|---|---|
| 208945 | 7/1957 | Australia | 273/73 C |
| 3204 | 7/1881 | United Kingdom | 273/73 C |
| 431394 | 7/1935 | United Kingdom | 273/73 G |
| 2196536 | 5/1988 | United Kingdom | 273/73 R |

*Primary Examiner*—Benjamin Layno

*Attorney, Agent, or Firm*—Rosenblum, Parish & Bacigalupi

[57] ABSTRACT

A two piece tennis racket comprising a strung, oval shaped head and a detachable handle unit which includes a grip forming portion and a head attachment portion which is preferably collapsible into or about the grip portion to accommodate compact stowage. The head and attachment portion are adapted to include suitable fastening means for allowing speedy connection and disconnection of the handle unit to the head.

15 Claims, 2 Drawing Sheets

TENNIS RACKET WITH SEPARABLE HEAD AND HANDLE ASSEMBLY

BACKGROUND OF THE INVENTION

1. Field of the Invention

The present invention relates generally to tennis rackets and more particularly to a novel racket design including a separable head and handle structure adapted to facilitate storage and transportation of the device.

2. Discussion of the Prior Art

Modern tennis rackets come in many configurations and materials, including woods, metals, fiberglass and various plastic materials. Rackets typically weigh about 12 ounces and are approximately 28" long. They have various shapes and grip configurations, and the heads are strung with different string tensions which depend upon the player, the opponent and weather conditions. Most players settle on a preferred type of grip and uses that grip type regardless of opponent and weather conditions. They normally change rackets only when they desire a different type of head having a different string tension or head weight. For this reason, most players use more than one racket.

Tennis players usually play at many court locations and frequently take their rackets with them when traveling, whether it be business or vacation. Since the racket is nearly 30" long and is of a shape which is not easily fit within a normal suitcase or attache case, carriage is often inconvenient. Furthermore, the problem is compounded when one desires to carry more than one racket as this obviously compounds the stowage and transportation problem.

SUMMARY OF THE PRESENT INVENTION

It is therefore a principal objective to the present invention to provide a novel tennis racket design which is separable into at least two parts.

Another object to the present invention is to provide a racket of the type described in which a single handle unit can be mated with any of a number of specially configured heads.

Yet another object to the present invention is to provide a device of the type described in which the handle unit is collapsible into a configuration which takes up a minimum of space and is of a length substantially shorter than when in its extended configuration.

A presently preferred embodiment of the present invention includes a strung, oval shaped head and a detachable handle unit which includes a grip forming portion and a head attachment portion which is preferably collapsible into or about the grip portion to accommodate compact stowage. The head and attachment portion are adapted to include suitable fastening means for allowing speedy connection and disconnection of the handle unit to the head.

Among the advantages of the present invention are that it provides a compact racket structure which when extended, does not differ markedly from a classical tennis racket, but when disconnected and/or collapsed occupies a substantially smaller volume of space and thereby facilitates its storage and/or transportation.

Another advantage of the present invention is that it provides a handle unit to which multiple specially configured heads may be interchangeably attached.

These and other objects and advantages of the present invention will no doubt become apparent to those skilled in the art after having read the detailed description of the preferred embodiment illustrated in the several figures of the drawing.

IN THE DRAWING

DESCRIPTION OF THE PREFERRED EMBODIMENT

Figure 1:
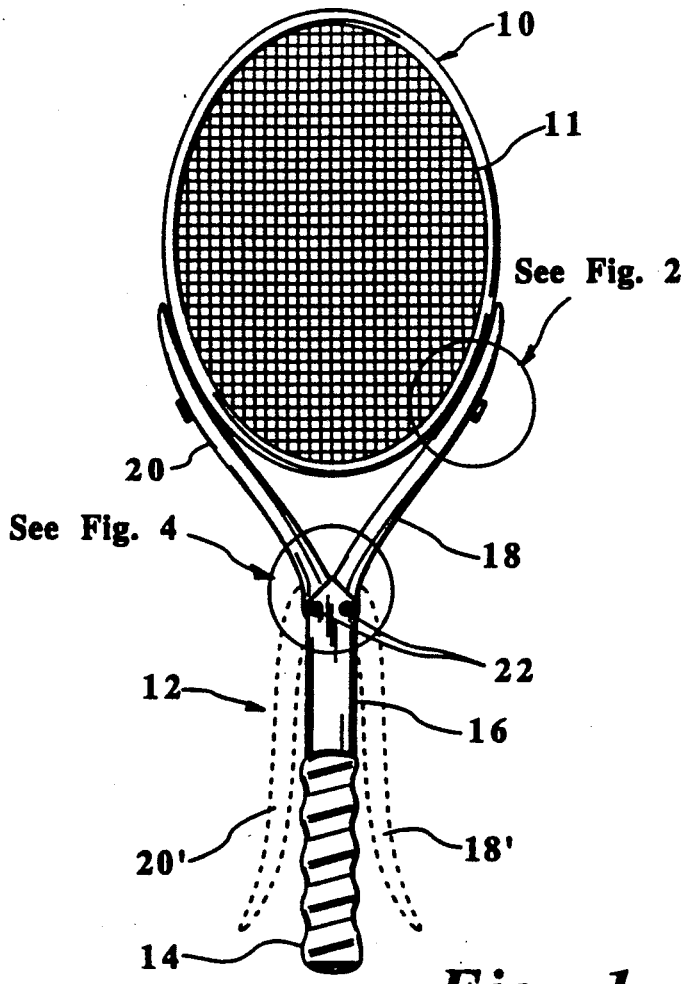
FIG. 1 depicts a racket device in accordance with the present invention.

Referring now to FIG. 1 of the drawing, a tennis racket in accordance with the present invention is shown to include an oval shaped head unit 10 formed by a strung rim 11, and a separable handle unit 12. As indicated, the unit 12 includes a grip forming portion 14, a shank forming portion 16, and a yoke formed by a pair of arms 18 and 20, the lower ends of which are pivotally connected to shank 16 by pivot pins 22 and the distal ends of which are connectible to the head 10 by suitable attachment means 24.

Figure 2:
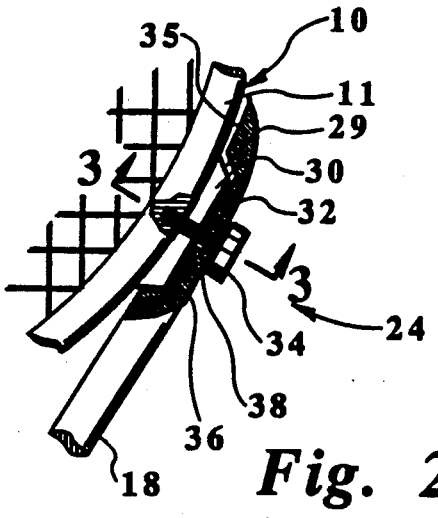
FIG. 2 is a partially broken illustration of the detail of the fastener encircled in FIG. 1.
Figure 3:
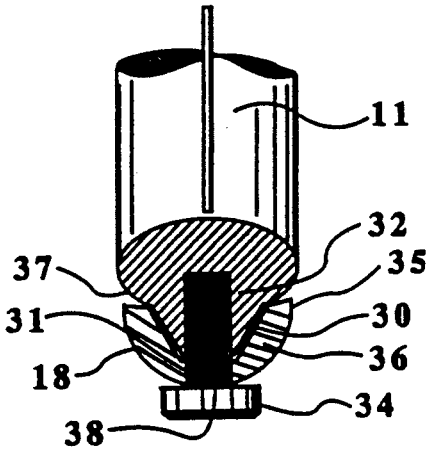
FIG. 3 is a cross-section taken along the line of 3—3 of FIG. 2.

As more clearly shown in the enlarged segment of a first encircled portion of the device including the attachment means 24 depicted in FIG. 2, the rim 11 of head unit 10 is provided with an integrally formed rib 30, the length of which extends parallel to the rim. Note that the ends 29 of rib 30 are tapered and, as illustrated in FIG. 3, the sidewalls are likewise tapered as indicated at 31. As further indicated in FIGS. 2 and 3, a tapped bore 32 extends through rib 30 and partially into rim 11 for receiving the threaded shaft of a thumbscrew 34.

The distal end portions of the arms 18 and 20 are configured to have a surface 35 (FIG. 3) shaped to correspond to the outer surface of the facing side 37 of rim 11. Extending into the surface 35, is an elongated groove 36 having tapered end and side surfaces adapted to be parallel to the corresponding surfaces of 30. In the preferred embodiment, groove 36 is sized slightly smaller than rib 30 such that when mated with rim 30, its sidewalls frictionally engage the corresponding sidewalls of and end walls of rib 30 and, as a consequence, maintain a slight separation between the surface 35 and the facing surface 37 of rim 11. Similarly, a slight spacing is maintained between the outermost surface of rib 30 and the bottom surface of groove 36. An opening 38 is provided in each arm, in alignment with the bore 32, to allow the shaft of thumbscrew 34 to pass therethrough and into engagement with bore 32.

With the attachment means configured as described above, it will be appreciated that when thumbscrew 34 is sufficiently advanced within bore 32, its head will engage the outer surface of arm 18 and draw it toward rim 11 causing the side and end surfaces of groove 36 to positively engage the sidewalls and end walls of rib 30 and thus effect a positive locking and rigid interconnection between arm 18 and rim 11. Although not depicted in detail, it will be appreciated that the upper portion of arm 20 is similarly configured, and a like engaging relationship will be accomplished by tightening a corresponding thumbscrew.

Figure 4:
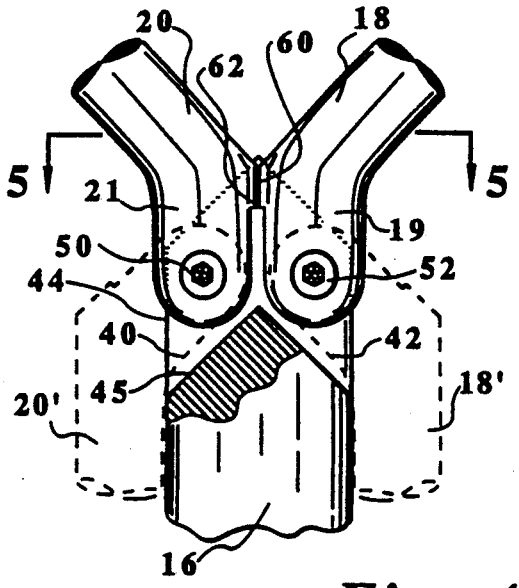
FIG. 4 is a partially broken illustration of the hinge structure encircled in FIG. 1.
Figure 6:
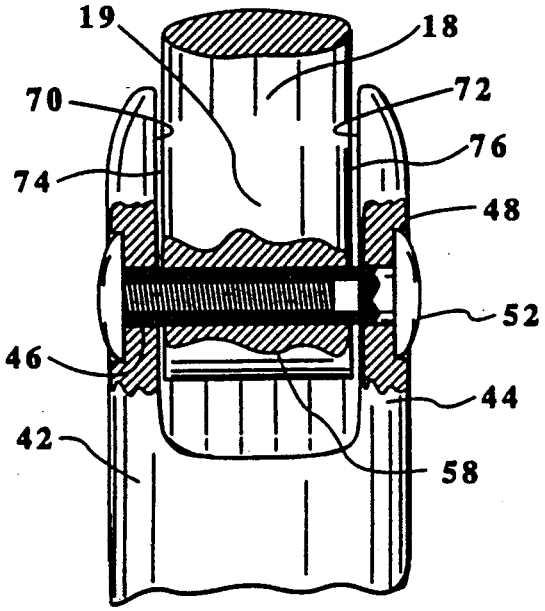
FIG. 6 is a partially broken cross-section taken along the line 6—6 of FIG. 5.
Figure 5:
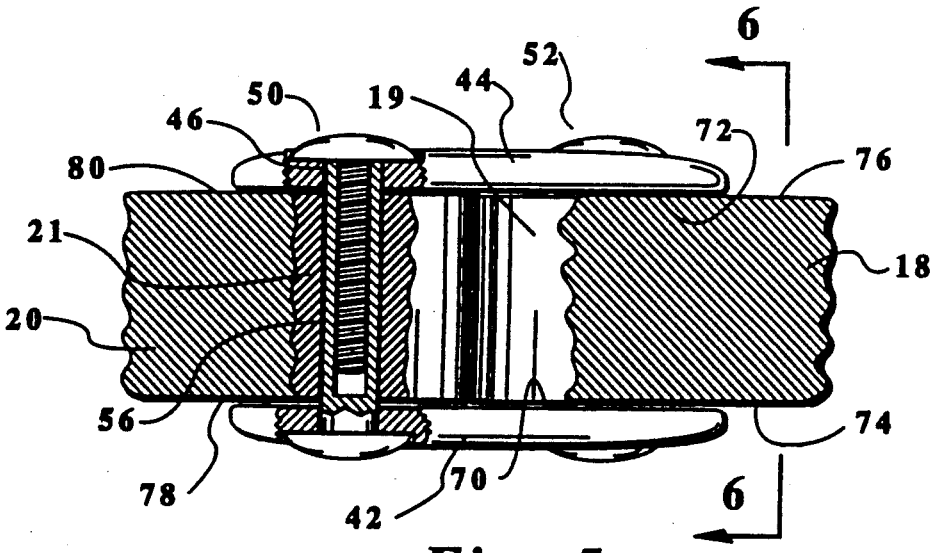
FIG. 5 is a cross-section taken along the line 5—5 of FIG. 4.

In FIGS. 4, 5 and 6 details of the upper end of shank 16 and the lower ends of arms 18 and 20 are depicted, along with their attachment detail. Note that the upper end of shank 16 is bifurcated to terminate in separated extensions 42 and 44 which define between them a recess for receiving the lower end portions 19 and 21 of arms 18 and 20 respectively. Note that arm ends 19 and 21 are extended in doglegged fashion from the main portions of arms 18 and 20 to accommodate rotation into the collapsed positions indicated by the doghead lines 18' and 20', and that the bottom surfaces 45 of the recess in shank 16 are tapered as best illustrated in FIG. 4.

As more clearly shown in FIGS. 5 and 6, the shank extensions 42 and 44, and the arm ends 19 and 21 are bored as indicated by the call-out numerals 46, 48 and 56 for receiving a pair of pivot pins 50 and 52. The pins 50 and 52 are preferably of the type which include one part having an internally threaded female member which is inserted into one side of the device, the outside surface 58 of such member providing the bearing surface for the pivot, and an externally threaded member which is inserted into the other side of the device and threaded into the female member. The pins are sized to have substantially zero clearance with the bores formed in the arm ends 19 and 21, and the shank extensions 42 and 44 so as to limit motion therebetween to rotation about the pins.

In accordance with the present invention, the opposing surfaces of the doglegged end portions 19 and 21, which are disposed within the recess 40, are made smooth and parallel to each other and adapted to frictionally engage the interior surfaces 70 and 72 of the shank extensions 42 and 44. Essentially zero clearance is provided between surfaces 70 and 74 and 78, and between surfaces 72 and 76 and 80, and the pivot pins 50 and 52 are tightened to prevent any wobbling motion between the several parts. By appropriately finishing and/or lubricating the contacting surfaces, even though tightly held together, the arms 18 and 20 will be pivotable about pins 50 and 52 when they are detached from the head 10.

As indicated in FIG. 4, the arm portions 19 and 21 are provided with slightly raised surfaces 60 and 62, which are intended to bear against each other when the distal ends of arms 18 and 20 are attached to head 10. By making the arms 18 and 20 slightly flexible, and diminishing them such that the distal ends thereof are sprung slightly outwardly from their head rib engaging separation, the act of fastening the two arms to the head serves to cause the surfaces 60 and 62 to act as a fulcrum about which the lower ends of the arms tends to rotate outwardly. However, since the ends are held in place by the pins 50 and 52, the assembled structure will be quite rigid in the plane of head 10.

With regard to maintaining rigidity of the assembled unit in the direction of the plane normal to the plane of head 10, the engagement between the ridges 30 and grooves 36, when tightly held together by thumbscrews 34 assure a wobble-free relationship between the yoke forming arms 18 and 20 and rim 11, and the engagement between surfaces 70 and 74 and 78, and 72 and 76 and 80, as held tightly together by pivot pins 50 and 52, preserves a wobble-free relationship between arms 18 and 20 and shank 16. Accordingly, with proper choice of materials for strength and weight, in use a player will note no difference between an embodiment of the present invention and a conventional racket.

After play when it is desired to stow, store or transport the racket, all that need be done in order to reduce the unit into a pair of compact components, is to rotate the thumbscrews 34 to disengage arms 18 and 20 from rim 11, and then rotate arms 18 and 20 downwardly into a position parallel to grip 14, as indicated by the dashed lines 18' and 20'.

In accordance with the present invention, a user could have a plurality of heads, each with different playing characteristics and could interchangeably affix them as desired to a single handle unit. This of course means that a number of heads could be carried in a single, flat, purse-like, and perhaps even oval shaped carrying case having a simple elongated pocket provided on one flat face thereof for containing the folded handle unit. Since the largest dimension of such a package would normally not exceed about 14", the entire device could be easily stowed within a small suitcase or attache case.

Although the present invention has been described above in terms of a presently preferred embodiment, it is contemplated that other means of attachment of the arms 18 and 20 to the rim 11 could likewise be used without departing from the invention. For example, an over center latching arrangement or the like could be substituted for the rib and thumbscrew attachment mechanism illustrated. Similarly, it is contemplated that the arm and pivot configuration could be modified to rotate inwardly rather than outwardly, and shank 16 could be made hollow with pins 22 (50 and 52), slidable within an internal groove so that the arms could be telescopically received therewithin.

Accordingly, it is intended that the above described and illustrated embodiment be considered as only a preferred embodiment and that the appended claims be interpreted to cover all alterations and modifications as fall within the true spirit and scope of the invention.

What is claimed is:

1. An improved tennis racket apparatus comprising:

a generally oval shaped racket head including a rigid rim for supporting a tensioned array of ball engaging strings;

a handle unit including a grip forming portion at one end and a shank forming portion at the other end;

yoke means including a pair of arms collapsibly associated with each other;

first fastening means for collapsibly securing one end of each of said arms to the distal end of said shank portion; and second fastening means for releasably fastening the other end of each of said arms to said rim whereby, when assembled, a tennis racket of generally conventional configuration is provided, and when disassembled by releasing said second attachment means and collapsing said arms relative to each other and to said shank forming portion, said racket apparatus is separated into two component parts, each of which has a maximum dimension equal to less than one-half the length of the assembled racket unit.

2. An improved tennis racket apparatus as recited in claim 1 wherein said first attachment means includes pivot pins for permitting said arms to be rotated between an extended position for engaging said head, and a retracted position generally parallel to said handle unit.

3. An improved tennis racket apparatus as recited in claim 2 wherein said shank portion is provided with a recess in said distal end for receiving said one ends of said arms, and said one ends of said arms are configured in doglegged fashion so as to allow them to be rotated from an outwardly extending yoke forming position to a retracted position parallel to said handle unit.

4. An improved tennis racket apparatus as recited in claim 3 wherein said arms are sprung inwardly toward each other when said other ends of said arms are fastened to said rim.

5. An improved tennis racket apparatus as recited in claim 2 wherein said second attachment means includes a pair of elongated ribs formed integral with said rim, matching elongated grooves formed in distal portions of each of said arms, and means for holding said ribs in mating engagement with said grooves to provide rigid interconnection therebetween.

6. An improved tennis racket apparatus as recited in claim 5 wherein said arms are sprung inwardly toward each other when said other ends of said arms are fastened to said rim.

7. An improved tennis racket apparatus as recited in claim 1 wherein said second attachment means includes a pair of elongated ribs formed integral with said rim, matching elongated grooves formed in distal portions of each of said arms, and means for holding said ribs in mating engagement with said grooves to provide rigid interconnection therebetween.

8. An improved tennis racket apparatus as recited in claim 7 wherein said arms are sprung inwardly toward each other when said other ends of said arms are fastened to said rim.

9. An improved tennis racket apparatus as recited in claim 1 wherein said shank forming portion is provided with a recess in the distal end portion thereof for receiving said one ends of said arms.

10. An improved tennis racket apparatus as recited in claim 9 wherein said one ends of said arms are pivotally attached to said shank forming portion and each said arm is rotatable from an outwardly extending yoke forming position to a retracted position alongside said handle unit.

11. An improved tennis racket apparatus as recited in claim 10 wherein said second attachment means includes a pair of ribs formed integral with said rim, matching grooves formed in distal portions of each of said arms, and means holding said ribs in mating engagement with said grooves to provide rigid interconnection therebetween.

12. An improved tennis racket apparatus as recited in claim 9 wherein said second attachment means includes a pair of ribs attached to said rim, matching grooves formed in distal portions of each of said arms, and means holding said ribs in mating engagement with said grooves to provide rigid interconnection therebetween.

13. An improved tennis racket apparatus as recited in claim 12 wherein said arms are sprung inwardly toward each other when said other ends of said arms are fastened to said rim.

14. An improved tennis racket apparatus as recited in claim 9 wherein said recess is formed in part by facing interior walls of said shank forming portion, said interior walls being adapted to frictionally engage opposing surfaces of said arms so as to prevent any wobbling motion between said arms and said yoke means.

15. An improved tennis racket apparatus as recited in claim 1 wherein said arms are sprung inwardly toward each other when said other ends of said arms are fastened to said rim.

* * * * *